US009481538B2

(12) United States Patent
Tsumura et al.

(10) Patent No.: US 9,481,538 B2
(45) Date of Patent: Nov. 1, 2016

(54) PAPER DISCHARGE DEVICE

(71) Applicant: RISO KAGAKU CORPORATION, Minato-ku, Tokyo (JP)

(72) Inventors: Akihiro Tsumura, Tsukuba (JP); Tetsunori Saito, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/639,591

(22) Filed: Mar. 5, 2015

(65) Prior Publication Data

US 2015/0344258 A1 Dec. 3, 2015

(30) Foreign Application Priority Data

May 27, 2014 (JP) ..... 2014-109441

(51) Int. Cl.
*B65H 29/14* (2006.01)
*B65H 29/52* (2006.01)
*B65H 31/02* (2006.01)

(52) U.S. Cl.
CPC ..... *B65H 29/14* (2013.01); *B65H 29/52* (2013.01); *B65H 31/02* (2013.01); *B65H 2301/4212* (2013.01); *B65H 2404/14211* (2013.01); *B65H 2404/61* (2013.01); *B65H 2404/6112* (2013.01); *B65H 2404/64* (2013.01); *B65H 2405/1111* (2013.01); *B65H 2405/11151* (2013.01); *B65H 2511/11* (2013.01); *B65H 2511/13* (2013.01); *B65H 2511/214* (2013.01); *B65H 2511/30* (2013.01); *B65H 2801/06* (2013.01)

(58) Field of Classification Search
CPC ..... B65H 29/14; B65H 29/18; B65H 29/50
See application file for complete search history.

(56) References Cited

U.S. PATENT DOCUMENTS

| | | | | |
|---|---|---|---|---|
| 6,669,191 | B2 * | 12/2003 | Lee | B41J 13/106 271/188 |
| 6,722,802 | B2 * | 4/2004 | Teo | B41J 13/106 101/417 |
| 8,172,224 | B2 * | 5/2012 | Kushida | B65H 29/14 271/200 |
| 8,267,399 | B2 * | 9/2012 | Kushida | B65H 31/3027 270/58.12 |
| 2015/0274472 | A1 * | 10/2015 | Momiyama | B65H 29/70 271/207 |
| 2015/0344254 | A1 * | 12/2015 | Sugitani | B65H 29/14 271/176 |

FOREIGN PATENT DOCUMENTS

| | | | |
|---|---|---|---|
| JP | 03088667 | A * | 4/1991 |
| JP | 10246998 | A | 9/1998 |
| JP | 2008110845 | A * | 5/2008 |

* cited by examiner

*Primary Examiner* — Jeremy R Severson
(74) *Attorney, Agent, or Firm* — Holtz, Holtz & Volek PC

(57) ABSTRACT

A paper discharge device including discharge rollers that discharge a paper sheet and a paper discharge tray on which discharged paper sheets are stacked further includes a control unit that controls the discharge angle of a paper sheet according to at least the stacked amount of paper sheets that are stacked on the paper discharge tray so that the position at which the front end of a paper sheet to be discharged begins to come into contact with the stacked paper sheets on the paper discharge tray is within a specified range from the front end of the stacked paper sheets.

3 Claims, 13 Drawing Sheets

PAPER DISCHARGE DEVICE

CROSS-REFERENCE TO RELATED APPLICATION

This application is based upon and claims the benefit of priority of the prior Japanese Patent Application No. 2014-109441, filed on May 27, 2014, the entire contents of which are incorporated herein by reference.

BACKGROUND OF THE INVENTION

1. Field of the Invention

The embodiments discussed herein are related to a paper discharge device, and particularly to a technique for improving alignment of discharged paper sheets in the paper discharge device.

2. Description of the Related Art

With respect to a paper discharge device, a technique is proposed for preventing misalignment of discharged paper sheets when the paper sheets are stacked so that the discharged paper sheets are stacked on a paper discharge tray in an aligned state. For example, there is a paper discharge device that is configured so that the front end of a paper sheet to be discharged is placed on stacked paper sheets after coming into contact with the stacked paper sheets by making a discharge angle shallow. FIGS. 11A, 11B, 11C, 12A and 12B illustrate examples of such a paper discharge device. When contact between a paper sheet and discharge rollers is released and the paper sheet is discharged in a state in which the paper sheet is not in contact with stacked paper sheets, the paper sheet falls freely and reaches the stacked paper sheets. Then, positions of paper sheets that have reached the stacked paper sheets are dispersed, and as a result, alignment of discharged paper sheets deteriorates. Therefore, by discharging a paper sheet that is in contact with the stacked paper sheets and preventing the paper sheet from falling off, alignment of discharged paper sheets is prevented from deteriorating.

FIG. 11A is a diagram illustrating paper sheet discharge in a state in which there are no stacked paper sheets. A paper discharge device 100 includes a paper discharge tray 102 on which a discharged paper sheet 200 is stacked, and one discharge roller pair 104 that sandwiches the paper sheet 200 from above and below. Note that in regard to direction, in line with movement of the paper sheet 200 to be discharged, the leftward direction in the figure is referred to as the downstream direction and the rightward direction in the figure is referred to as the upstream direction.

The discharge roller pair 104 causes the paper sheet 200 to be discharged on the paper discharge tray 102 at such a discharge angle that the paper sheet is directed downward to the downstream side in the S direction. Then, the front end of the paper sheet 200 to be discharged begins to come into contact with the paper discharge tray 102 while the paper sheet 200 is conveyed by the paper discharge roller pair 104. Note that the discharge angle is determined by the angle of the paper discharge roller pair 104, etc.

FIG. 11B is a diagram illustrating paper sheet discharge in a state in which there are a few stacked paper sheets 210. In a state in which there are a few stacked paper sheets 210, the front end of the paper sheet 200 to be discharged is positioned at almost the same position as that in FIG. 11A, and begins to come into contact with the uppermost face of the stacked paper sheets 210. The distance between the contact start position and the front end position of the stacked paper sheets 210 is set to R. R is the contact length between the paper sheet 200 to be discharged and the uppermost face of the stacked paper sheets 210.

FIG. 11C is a diagram illustrating paper discharge in a state in which there are many stacked paper sheets 210. When the stacked amount (the number of stacked sheets) of the stacked paper sheets 210 increases, the contact start position of the front end of the paper sheet 200 to be discharged moves to an upstream side. That is, the contact length R becomes longer in comparison with that in a state in which there are fewer stacked paper sheets 210. When the stacked amount of the stacked paper sheets 210 increases, since the paper sheet 200 to be discharged is in contact with the uppermost face of the stacked paper sheets 210 for a longer time, the portion of the uppermost sheet of the stacked paper sheets 210 that is pushed out in the T direction by the paper sheet 200 to be discharged increases. Thus, alignment of discharged paper sheets deteriorates. As described, the paper discharge device 100 illustrated in FIG. 11C may prevent deterioration in alignment of discharged paper sheets due to falling-off of paper sheets; however, when there is a large stacked amount (number of stacked sheets), the paper discharger device 100 causes deterioration in alignment of discharged paper sheets due to pushing-out of paper sheets.

FIGS. 12A and 12B are diagrams illustrating how alignment of discharged paper sheets deteriorates when the size of the paper sheet 200 is large. For example, FIG. 12A illustrates a case in which the paper sheet 200 is A4 size (the size that is defined by ISO216, 210 mm×297 mm), and FIG. 12B illustrates a case in which the paper sheet 200 is A3 size (the size that is defined by ISO216, 297 mm×420 mm). When the paper sheet 200 is A3 size, the contact length R becomes longer and the contact time between the paper sheet 200 to be discharged and the uppermost face of the stacked paper sheets 210 becomes longer as compared with that when the paper sheet is A4 size. Therefore, even when the stacked amounts are the same, when the size of the paper sheet 200 becomes larger, alignment of discharged paper sheets deteriorates.

Although the paper discharge device 100 in which the contact start position moves to an upstream side when the stacked amount increases has been described in FIG. 11C, a paper discharge device 150 is proposed that is configured to lower the paper discharge tray 102 according to a stacked amount in order to stabilize the contact start position regardless of the stacked amount.

FIGS. 13A and 13B illustrate examples of the paper discharge device 150. FIG. 13A illustrates a state in which the stacked amount of the stacked paper sheets 210 is small, and FIG. 13B illustrates a state in which the stacked amount of the stacked paper sheets 210 is large. As illustrated in FIG. 13B, the paper discharge device 150 detects an increase in the stacked height of the stacked paper sheets 210 and lowers the paper discharge tray 102 using a motor or the like by the increased amount. Thus, the contact length R is made approximately constant regardless of the stacked amount of the stacked paper sheets 210, and deterioration in alignment of discharged paper sheets due to the influence of the stacked amount is prevented. An example of the paper discharge device configured to lower the paper discharge tray 102 is disclosed in Japanese Laid-open Patent Publication No. H10-246998.

SUMMARY OF THE INVENTION

The paper discharge device as illustrated in FIGS. 13A and 13B that includes a mechanism for lowering the paper discharge tray 102 prevents deterioration in alignment of discharged paper sheets due to the influence of the stacked amount. However, since the paper discharge tray 102 to which the weight of the stacked sheets is added becomes quite heavy, great structural strength is required in order to move such a paper discharge tray 102 up and down. Thus, provision of the moving structure of the paper discharge tray 102 will lead to an increase in the weight and size of the paper discharge device. In addition, a drive system for moving the paper discharge tray 102 requires a large amount of electric power.

In view of the above problem, an aspect of the invention of the present application is directed to provision of a compact paper discharge device improved in alignment accuracy of discharged paper sheets.

In order to attain the above objective, an aspect of the invention of the present application is directed to a paper discharge device that includes discharge rollers configured to discharge a conveyed paper sheet, and a paper discharge tray on which discharged paper sheets are stacked. The paper discharge device further includes a control unit that controls the discharge angle of a paper sheet according to at least the stacked amount of paper sheets that are stacked on the discharge tray so that the position at which the front end of the paper sheet to be discharged begins to come into contact with the stacked paper sheets that are stacked on the paper discharge tray is within a specified range from the front end of the stacked paper sheets while the paper sheet is discharged by the discharge rollers.

According to an aspect of the invention of the present application, the compact paper discharge device with improved alignment accuracy of discharged paper sheets may be provided.

DESCRIPTION OF EMBODIMENTS

Figure 1:
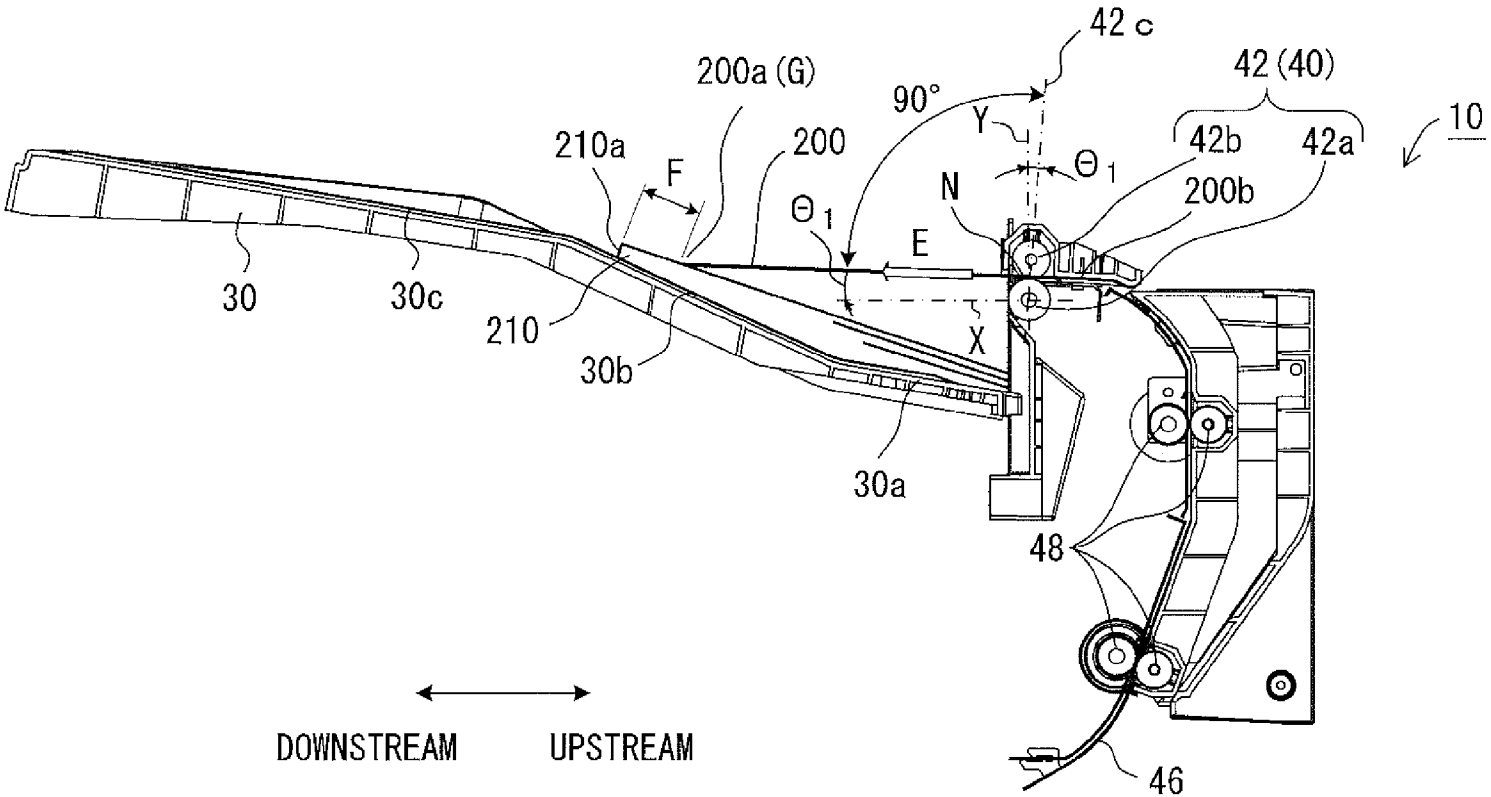
FIG. 1 is a side view of a paper discharge device and illustrates a main structure related to paper discharge.

Hereinafter, the embodiments of the present invention will be described with reference to the drawings. FIG. 1 is a side view of the paper discharge device 10 to which the embodiments of the present invention are applied, and is a diagram illustrating a main structure related to paper discharge. Note that in the embodiments the paper discharge device 10 that is provided in an image forming device 1 will be described as an example.

The image forming device 1, described briefly, includes a printing unit (not shown) configured to create information such as a character, an image, etc. on a paper sheet, a paper sheet storage unit (not shown) configured to store paper sheets to be fed to the printing unit, a conveying unit (not shown) configured to convey a paper sheet inside the device, the paper discharge device 10 configured to discharge a paper sheet on which an image is formed, and the like.

The paper discharge device 10 includes a paper discharge tray 30, a discharge roller unit 40, a discharged paper conveying path 46, and conveying rollers 48. With respect to the right and left directions in the drawing, in line with movement of a paper sheet 200 to be discharged, the leftward direction is referred to as the downstream direction and the rightward direction is referred to as the upstream direction. The ends on the downstream side and the ends on the upstream side of the paper sheet 200 and stacked paper sheets 210 are referred to as front ends and rear ends, respectively.

The paper discharge tray 30 is configured to stack thereon and hold the paper sheet 200 that is discharged from the discharge roller unit 40. The discharge tray 30 includes a first face 30*a*, a second face 30*b*, and a third face 30*c* in this order from the upstream side as faces on which the paper sheet 200 is stacked.

The discharge roller unit 40 is configured to discharge the paper sheet 200 that has been conveyed from the image forming device 1 to the paper discharge tray 30. The discharge roller unit 40 includes one discharge roller pair 42 that conveys the paper sheet 200 by sandwiching it from above and below, and an angle adjustment unit 44 that changes the angle of the discharge roller pair 42. The angle adjustment unit 44 changes the angle of the discharge roller pair 42 so that the paper sheet 200 is discharged at a specified discharge angle. Details of the angle adjustment unit 44 will be described in FIGS. 6 and 7.

The discharge roller pair 42 is configured to discharge a paper sheet that has been conveyed, and includes a set of a lower drive roller 42*a* and an upper driven roller 42*b*. The driven roller 42*b* is pressed against the drive roller 42*a* by means of a spring or the like with a specified force. The drive roller 42*a* is rotated by means of a drive motor (not shown) and a transmission system from the drive motor.

The discharged paper conveying path 46 is a path for the paper sheet 200 that is provided to guide the paper sheet 200 that has been sent from the printing unit of the image forming device 1 to the discharge roller pair 42. The conveying rollers 48 are appropriately provided on the discharged paper conveying path 46, and transfer the paper sheet 200 to the discharge roller pair 42 by sandwiching the paper sheet 200 with one pair of rollers.

FIG. 1 illustrates a state in which the front end 200*a* of the paper sheet 200 begins to come into contact with the stacked paper sheets 210 in a state in which the stacked amount (the number of stacked sheets) of the stacked paper sheets 210 is small. The front end 200*a* of the paper sheet 200 that has been discharged from the discharge roller pair 42 comes into contact with the stacked paper sheets 210 in a state in which the rear end 200*b* of the paper sheet 200 has not yet reached the nip point N of the discharge roller pair 42.

The angle between the discharge direction E of the paper sheet 200 and the X axis in the horizontal direction is set to the discharge angle θ. Note that θ is expressed as $\theta_1$ in FIG. 1. The distance from the contact start position G between the front end 200*a* of the paper sheet 200 and the uppermost face of the stacked paper sheets 210 to the front end 210*a* of the stacked paper sheets 210 is set to the contact length F between the paper sheet 200 and the stacked paper sheets 210 during discharge of the paper sheet 200.

The angle adjustment unit 44 adjusts the discharge angle θ by the angle of the discharge roller pair 42. The angle discharge unit 44 adjusts the angle of the discharge roller pair 42 at the discharge angle that enables the front end 200*a* of the paper sheet 200 to reach the contact start position G that makes the contact length F a specified distance (range).

It is assumed that the line that passes through the centers of the drive roller 42*a* and the driven roller 42*b* are set to a roller inclination line 42*c*, and that the direction orthogonal) (90° to the roller inclination line 42*c* matches the discharge direction E of the paper sheet 200. Note that the discharge direction E may deviate from the direction orthogonal (90°) to the roller inclination line 42*c* since the discharge direction E is affected by the pressing force and the friction coefficient of the discharge roller pair 42. However, since the discharge direction E is dominantly determined by the angle of the discharge roller pair 42, it is hereinafter assumed that the direction orthogonal to the roller inclination line 42*c* is the discharge direction E. Therefore, the angle between the roller inclination line 42*c* and the Y axis in the vertical direction is equal to the discharge angle θ ($\theta_1$).

Note that the angle adjustment unit 44 may adjust the discharge angle θ also by means other than the discharge roller pair 42, which will be described in FIGS. 8A-10B.

In order to reduce deterioration in alignment of discharged paper sheets of the stacked paper sheets 210 due to being pushed up by the paper sheet 200, it is preferable to shorten the contact length F by bringing the contact start position G closer to the front end 210*a* of the stacked paper sheets 210. This is because the time (distance) during which the stacked paper sheet 210 is pushed up by the paper sheet 200 shortens.

However, since there is dispersion in the discharge direction E of the paper sheet 200, when the contact start position G is set to be on the edge of the front end 210*a* of the stacked paper sheets 210, there may be a case in which the paper sheet 200 falls off after passing over the front end 210*a* of the stacked paper sheets 210 and is placed on the stacked paper sheets 210. When the paper sheet 200 falls onto the stacked paper sheets 210 and is placed thereon, paper discharge is misaligned and the alignment of discharged paper sheets deteriorates.

Therefore, the contact start position G is set at a position which is close to the front end 210*a* of the stacked paper sheets 210 and at which the paper sheet 200 surely comes into contact with the stacked paper sheets 210. For example, the contact start position G is set at ¼-⅛ of the typical paper sheet length from the front end 210*a* of the stacked paper sheets 210. Specifically, when it is assumed that the paper sheet size is A4 (the size that is defined by ISO216, 210 mm×297 mm) and the paper sheet is discharged in the longitudinal direction (the paper sheet length in the discharge direction is 297 mm), F=37-74 mm.

Figure 2:
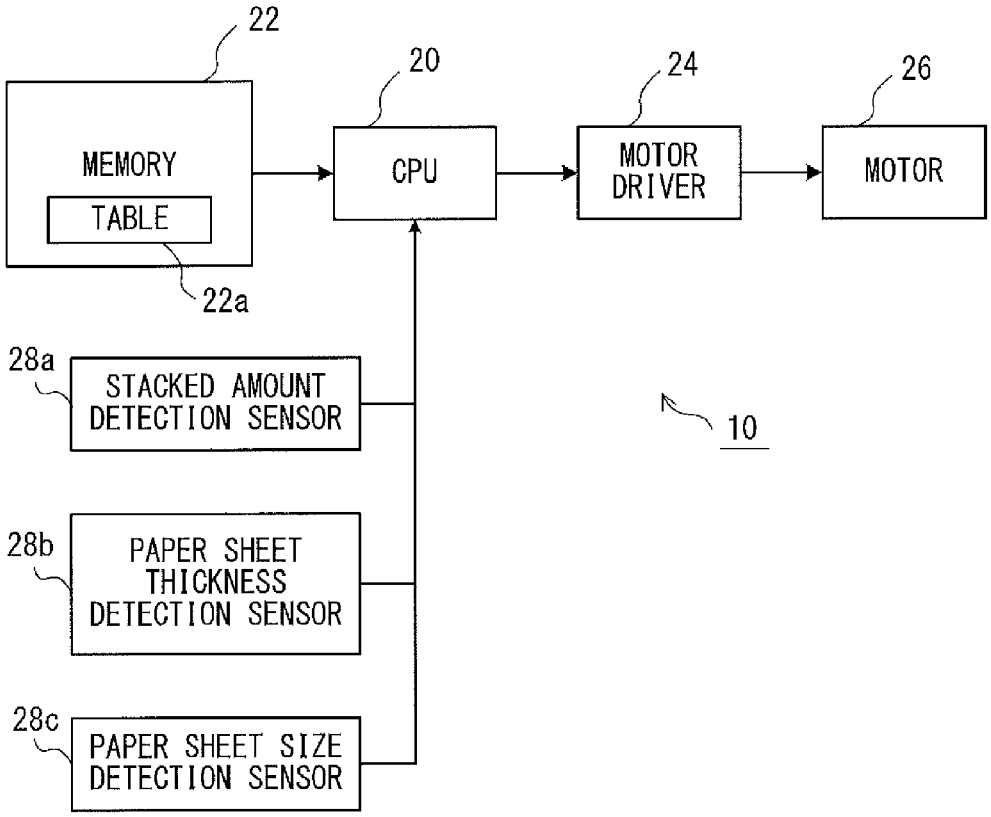
FIG. 2 is a block diagram related to discharge angle control of the paper discharge device.

FIG. 2 is a block diagram related to discharge angle control of the paper discharge device 10. The paper discharge device 10 includes a CPU 20, a memory 22, a stacked amount detection sensor 28*a*, a paper sheet thickness detection sensor 28*b*, a paper sheet size detection sensor 28*c*, a motor driver 24, and a motor 26.

The CPU 20 is a control unit that loads a control program and controls the entirety of the paper discharge device 10. Note that the CPU 20 is not dedicated to the paper discharge device 10 and may function also as the CPU of the image forming device 1. The memory 22 is a nonvolatile storage unit configured to store the control program that executes a control process of the paper discharge device 10. The memory 22 stores a table 22*a* in which discharge angles corresponding to stacked amounts and kinds of paper sheets are set in advance.

The stacked amount detection sensor 28*a* is configured to detect the height (stacked amount) of stacked paper sheets 210 that are stacked on the paper discharge tray 30. The stacked amount detection sensor 28*a* may be an optical sensor that detects the uppermost face position of the stacked paper sheets 210, a weight sensor that measures the weight of the stacked paper sheets 210, or a sensor that detects passage of a paper sheet in order to count the number of paper sheets.

The paper sheet thickness detection sensor 28*b* detects the thickness of the paper sheet 200 to be discharged. The paper sheet thickness detection sensor 28*b* may be either anon-contact sensor or a contact sensor. The paper sheet size detection sensor 28*c* detects the size of the paper sheet 200 to be discharged, especially the size in the discharge direction. For example, the paper sheet size detection sensor 28*c* detects passage of the front end and the rear end of the paper sheet in the conveyance path and notifies the CPU 20 of the timings thereof. The CPU 20 may calculate the size of a paper sheet from the passage time of the paper sheet. Note that the CPU 20 may obtain and use data on the paper sheet size that is otherwise detected from the image forming device 1, and in this case the paper sheet size detection sensor 28*c* is not necessary.

The CPU 20 judges the paper sheet stacked amount and the kind of paper sheet from data from the stacked amount detection sensor 28*a*, the paper sheet thickness detection sensor 28*b*, and the paper sheet size detection sensor 28*c*, and calculates the discharge angle θ with reference to the table 22*a*. The CPU 20 calculates a change angle from the set discharge angle θ, calculates the corresponding rotation angle of the motor 25, and notifies the motor driver 24 of the rotation angle. The CPU 20 may control the discharge angle θ of the paper sheet 200 according to only the stacked amount of stacked paper sheets 210 or the kind of paper sheet. As for the kind of paper sheet, at least one of a paper sheet size, thickness, and the length in the discharge direction may be possible, or another related attribute (surface nature) may be possible. Note that the CPU 20 is also referred to as the control unit.

In other words, the CPU 20 controls the discharge angle θ of the paper sheet 200 according to at least the stacked amount of the stacked paper sheets 210 that are stacked on the paper discharge tray 30 so that the position at which the front end 200*a* of the paper sheet 200 to be discharged begins to come into contact with the stacked paper sheets 210 that are stacked on the paper discharge tray 30 is within a specified range (the contact length F) from the front end of the stacked paper sheets 210 while the paper sheet 200 is discharged by the discharge roller pair 42.

Figure 3:
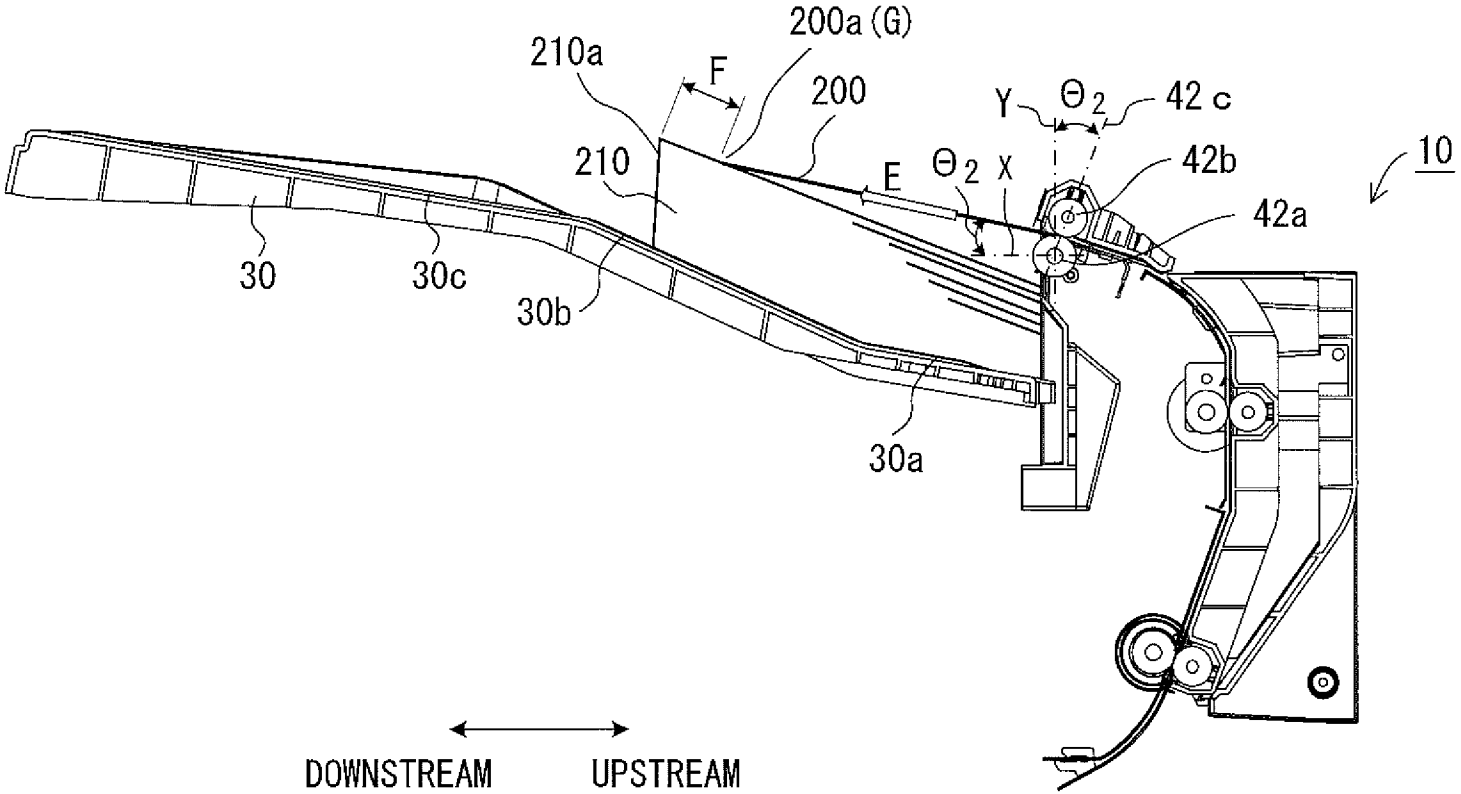
FIG. 3 is a diagram illustrating a state in which the stacked amount of stacked paper sheets increases from that in FIG. 1.

The motor driver 24 is configured to drive the motor 26 according to instructions from the CPU 20. The motor 26 is included in the angle adjustment unit 44, and changes the angle of the discharge roller pair 42 by means of a drive signal from the motor driver 24. For example, the motor 26 is a step motor and is rotated by an angle according to the input number of steps. FIG. 3 is a diagram illustrating a state in which the stacked amount of stacked paper sheets 210 has increased in comparison with that in FIG. 1. The angle adjustment unit 44 adjusts the angle of the discharge roller pair 42 (discharge angle θ) to $\theta_2$ which is further upward than $\theta_1$ so that the contact length F does not change even when the stacked amount of stacked paper sheets 210 has increased. The CPU 20 detects the stacked amount of stacked paper sheets 210 by means of the stacked amount detection sensor 28*a*, calculates the discharge angle θ corresponding to the stacked amount with reference to the table 22*a*, computes the rotation amount of the motor 26, and notifies the motor driver 24 of the rotation amount. The motor 26 is rotated by a specified amount due to being driven by the motor driver 24, and the angle of the discharge roller pair 42 is changed to $\theta_2$.

As described, even when the stacked amount of stacked sheets 210 has increased, since the discharge angle θ is changed upward and the contact length F is maintained within a fixed range, the time during which the stacked paper sheets 210 are pushed up by the paper sheet 200 does not become long and deterioration in alignment of discharged paper sheets due to pushing-up by the paper sheet 200 is prevented.

Figure 4:
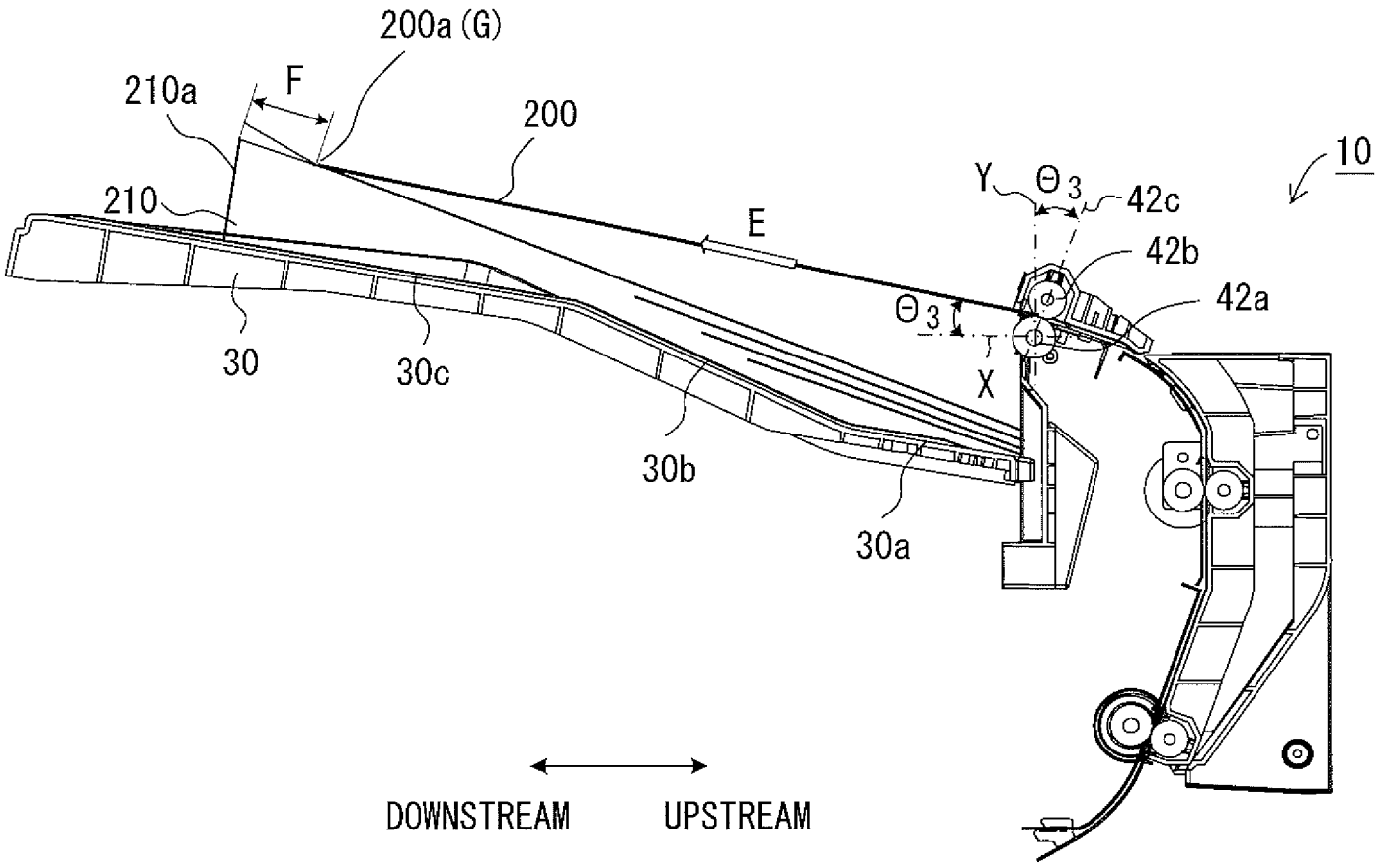
FIG. 4 is a diagram illustrating a state in which a paper sheet that has a larger size than that in FIG. 1 is used.

FIG. 4 is a diagram illustrating a state in which a paper sheet that has a larger size compared with that in FIG. 1 is used. For example, the paper sheet size in FIG. 1 is A4 and the paper sheet size in FIG. 4 is A3 (the size that is defined by ISO216, 297 mm×420 mm). When the size of the paper sheet 200 increases, the contact start position G with respect to the paper discharge tray 30 remains the same; however, the front end 210*a* of the stacked paper sheets 210 moves to a downstream side, so that the contact length F increases. In order to keep the contact length F within a fixed range, it is necessary to correspondingly move the contact start position G to the downstream side. The discharge angle $\theta_1$ is changed to $\theta_3$, which is upward from the downstream side so that the contact length F becomes the same as that of the stacked paper sheets 210 smaller in size in FIG. 1.

Figure 5:
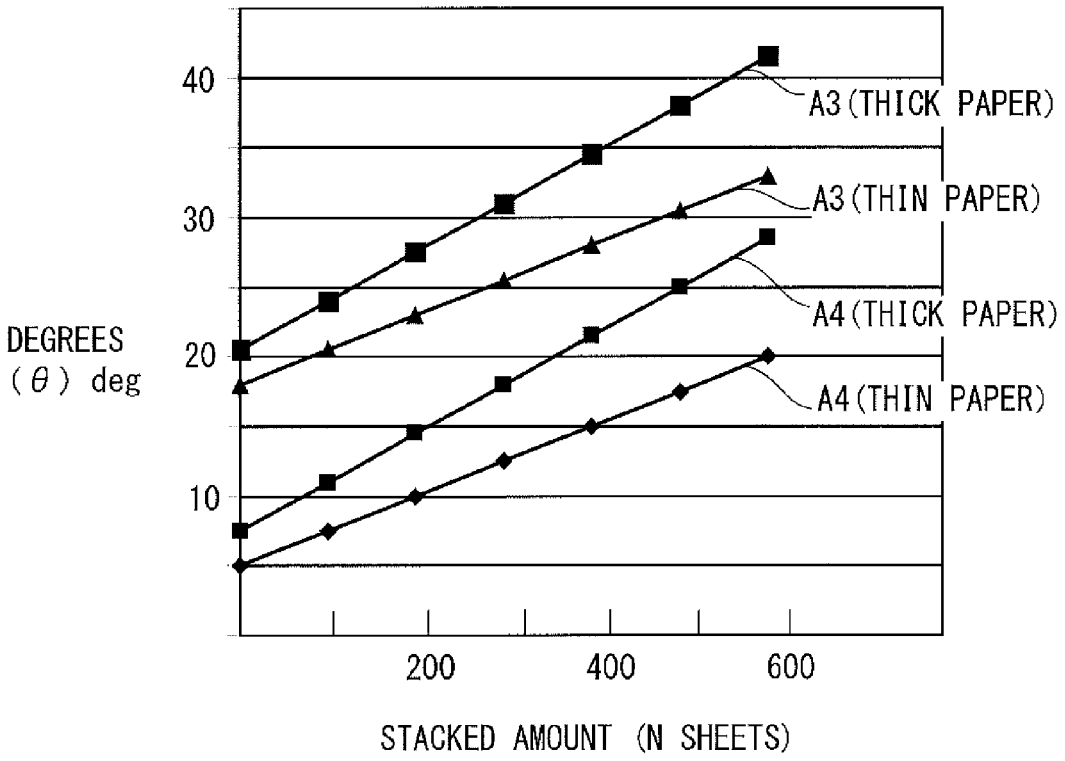
FIG. 5 is a diagram graphically illustrating the relationship between the discharge angle θ and the stacked amount with respect to the kind of paper sheet.

FIG. 5 is a graph illustrating the relationship between the angle of the discharge roller pair 42 (discharge angle θ) and the stacked amount with respect to the kind of paper sheet. FIG. 5 is obtained by graphically illustrating the content that is described in the table 22*a*. Regardless of the size and thickness of the paper sheet 200, the discharge angle θ is increased according to an increase in the stacked amount. When the size of the paper sheet 200 is large, that is, when the paper sheet length along the discharge direction is increased, the discharge angle θ is increased even when the stacked amount remains the same, which is illustrated in the example depicted in FIG. 4.

When the thickness of the paper sheet 200 is thick even when the paper sheet size is the same, the discharge angle θ is set to be large. This is because, since an increase in the thickness of the paper sheet 200 increases its stiffness and the pushing-up force thereof, the contact length F is set to be shorter accordingly. Note that the numerical values indicated in FIG. 5 are merely examples. Since the actual discharge angle θ is affected by the pressing force of the discharge roller pair 42, the material of the discharge roller pair 42, the material of the paper sheet, or the like, as well as the angle of the discharge roller pair 42, the angle of the discharge roller pair 42 changes depending on these parameters.

As described, the CPU 20 judges the stacked amount and the kind of paper sheet by means of the stacked amount detection sensor 28*a*, the paper sheet thickness detection sensor 28*b*, and the paper sheet size detection sensor 28*c*, and calculates the angle of the discharge roller pair 42 with reference to the table 22*a*.

Figure 6:
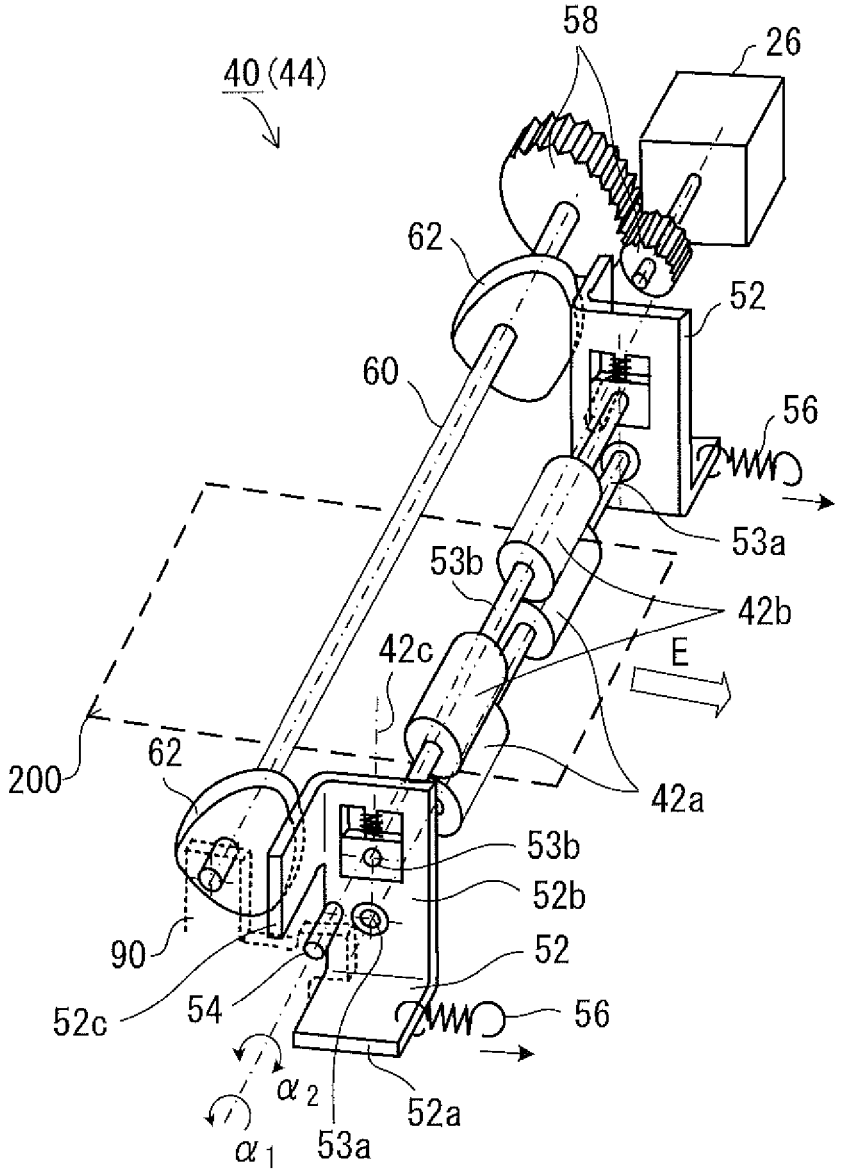
FIG. 6 is a first example of an angle adjustment unit of a discharge roller unit.

FIG. 6 is a first example of the angle adjustment unit 44 of the discharge roller unit 40. The angle adjustment unit 44 of the first example is configured to change the angle of the discharge roller pair 42 by using cams. FIG. 6 is a perspective view of the discharge roller unit 40 seen from opposite in FIG. 1, from the direction in which the paper sheet 200 is discharged to the right.

The discharge roller unit 40 has the discharge roller pair 42 and the angle adjustment unit 44. Two discharge roller pairs 42 each composed of the drive roller 42*a* and the driven roller 42*b* are provided. A roller shaft 53*a* that supports the drive rollers 42*a* and the roller shaft 53*b* that supports the driven rollers 42*b* are provided. Roller frames 52 that rotatably support the roller shaft 53*a* and the roller shaft 53*b* are provided at the right and left ends.

The right and left roller frames 52 have symmetric shapes. The roller frame 52 includes a bottom section 52*a*, a shaft support section 52*b* that vertically extends from the bottom section 52*a* and supports the roller shaft 53*a* and the roller shaft 53*b*, and a side section 52*c* that is provided at the upper part of the shaft support section 52*b* and extends in parallel to the axial direction of the roller shaft 53*a*.

A frame shaft 54 is provided outward in the right and left directions near the roller shaft 53*a* of the shaft support section 52*b* of each of the right and left roller frames 52. The right and left frame shafts 54 are pivotally supported on abase member 90, part of which is illustrated with dotted lines. The base member 90 is fixed to the paper discharge device 10. One end of each of the energizing springs 56 is locked to the bottom sections 52*a* of each of the right and left roller frames 52. The other end of the energizing spring 56 is locked to the base member 90. Thus, the discharge roller pairs 42 are rotatably supported by the base member 90 around the frame shafts 54, and are energized in the counterclockwise direction (al direction) around the frame shafts 54.

The motor 26 for changing the angle of the discharge roller pairs 42 is arranged near the roller frame 52. The motor 26 is also fixed to the base member 90. A transmission unit 58 composed of a combination of a plurality of gears is provided on the output shaft of the motor 26, and two cams 62 that have the same shape are coupled to the transmission shaft 60 of the transmission unit 58. The transmission shaft 60 is rotatably supported by the base member 90.

The two cams 62 are provided at positions corresponding to the side sections 52*c* of the roller frames 52 at angles of the same phase. Since the roller frame 52 is energized in the al direction, the cam 62 comes into contact with the side section 52*c* of the roller frame 52.

According to the above configuration, the angle of the cam 62 is changed due to a specified rotation of the motor 26 that is driven by the motor driver 24, and the roller frame 52 correspondingly rotates in the $\alpha_2$ direction around the frame shaft 54, which is provided near the roller shaft 53*a*. The angle of the discharge roller pair 42 is changed according to the rotation angle of the right and left roller frames 52.

Figure 7:
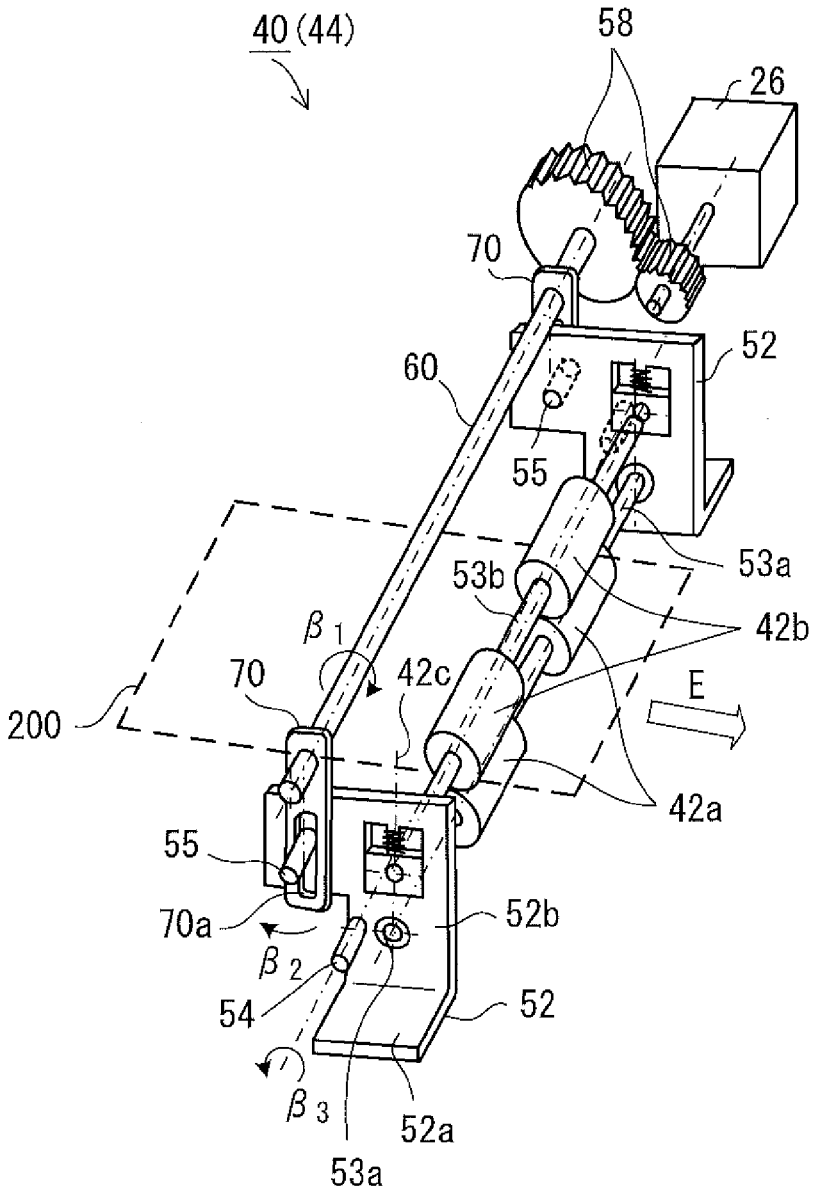
FIG. 7 is a second example of the angle adjustment unit of the discharge roller unit.

FIG. 7 is a second example of the angle adjustment unit 44 of the discharge roller unit 40. The angle adjustment unit 44 of the second example is configured to change the angle of the discharge roller pair 42 using links. Descriptions of the same portion as that in the first example will be omitted and a description will be made focusing on the points of difference.

Link pins 55 of the roller frames 52 are provided at the shaft support sections 52*b* of the right and left roller frames 52 in a direction parallel to the roller shaft 53*a*. Instead of the cam 62, one link 70 is provided at each of the right and left sides of the transmission shaft 60. The link 70 has an elongated shape and an elongated link groove 70*a* is formed inside thereof. The link 70 is provided fixed to the transmission shaft 60 and the link pin 55 is fitted to the link groove 70*a* of the link 70.

It is assumed that the transmission shaft 60 is rotated in the $\beta_1$ direction due to rotation of the motor 26. The link 70 correspondingly rotates in the $\beta_2$ direction around the transmission shaft 60. Rotation of the link 70 causes the link pin 55 that is fitted to the link groove 70*a* of the link 70 to move in the downward left direction, and in response to the movement of the link pin 55, the roller frame 52 rotates in the $\beta_2$ direction. Thus, the angle of the discharge roller pair 42 is changed to an upward angle.

Next, another example of discharge angle adjustment means will be described. In the above embodiment, with respect to the angle adjustment unit 44, a configuration that adjusts the discharge angle by changing the angle of the discharge rollers has been described. However, discharge angle adjustment is not limited to this. Hereinafter, other discharge angle adjustment means will be briefly described.

Figure 8A:
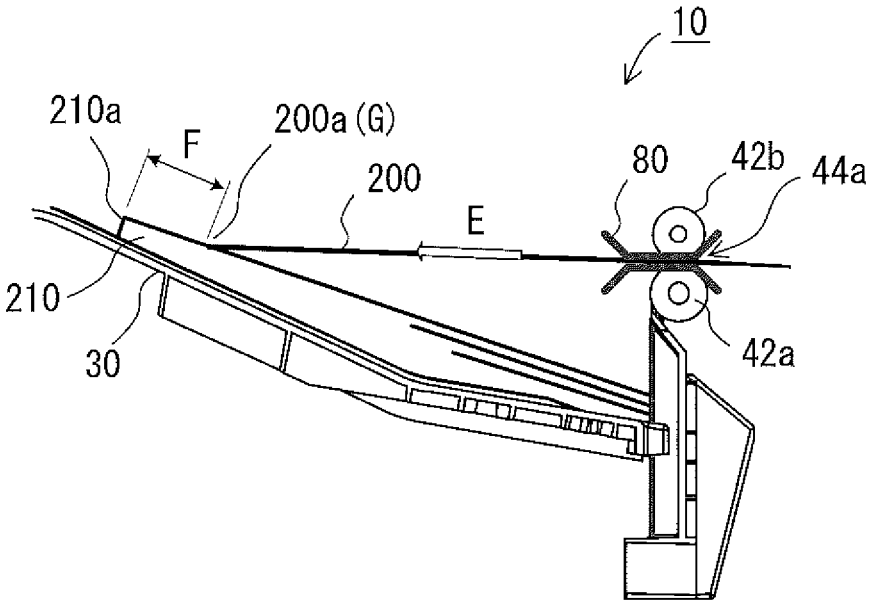
FIG. 8A is a diagram illustrating an example of discharge angle adjustment that is performed by a paper discharge guide.
Figure 8B:
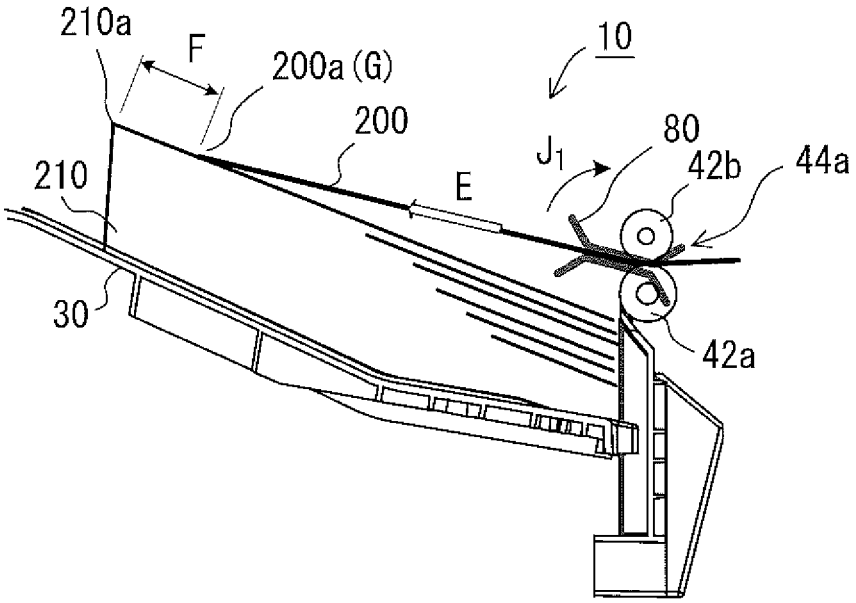
FIG. 8B is a diagram illustrating an example of discharge angle adjustment that is performed by the paper discharge guide.

FIGS. 8A and 8B are diagrams illustrating examples of discharge angle adjustment that is performed by a paper discharge guide. The same portion as that in FIG. 1 is denoted by the same reference numeral and the description thereof will be omitted. FIG. 8A illustrates a state in which the stacked amount is small, and FIG. 8B illustrates a state in which the stacked amount is large. The paper discharge guide 80 is provided at a discharge port and is configured to guide the paper sheet 200 to be discharged from the discharge roller pairs 42.

The paper discharge guide 80 is provided with an angle adjustment unit 44*a* that adjusts the angle thereof. The angle adjustment unit 44*a* has a mechanism that is illustrated in FIGS. 6 and 7, and instead of the discharge roller pairs 42, the angle adjustment unit 44*a* changes the angle of the paper discharge guide 80. The angle of the paper discharge guide 80 is adjusted due to control performed by the CPU 20 according to the stacked amount of paper sheets and the kind of paper sheet. In response to the increase in the stacked amount, the angle adjustment unit 44*a* adjusts the angle of the paper discharge guide 80 upward ($J_1$ direction) and increases the discharge angle $\theta$. The discharge direction E of the paper sheet 200 is changed upward, and the contact length F is kept constant regardless of the stacked amount. The same applies to the change in the kind of paper sheet.

Figure 9A:
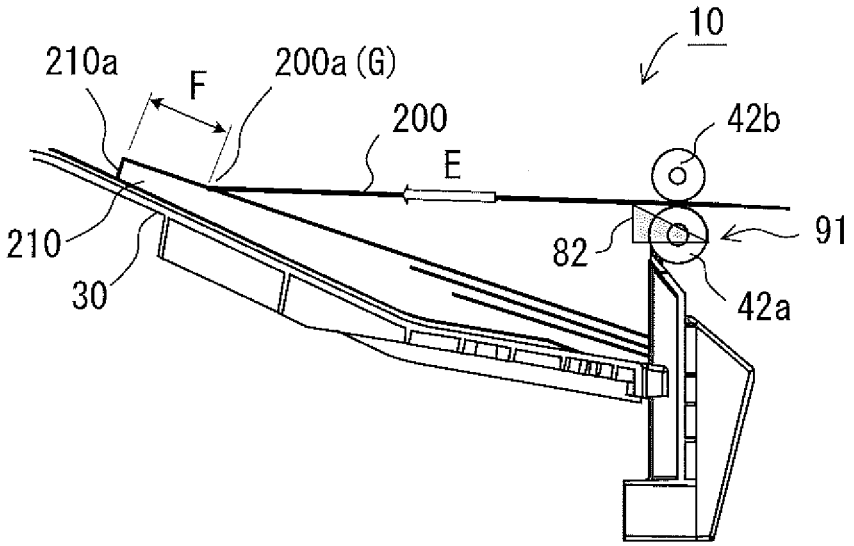
FIG. 9A is a diagram illustrating an example of discharge angle adjustment that is performed by a paper discharge wing.
Figure 9B:
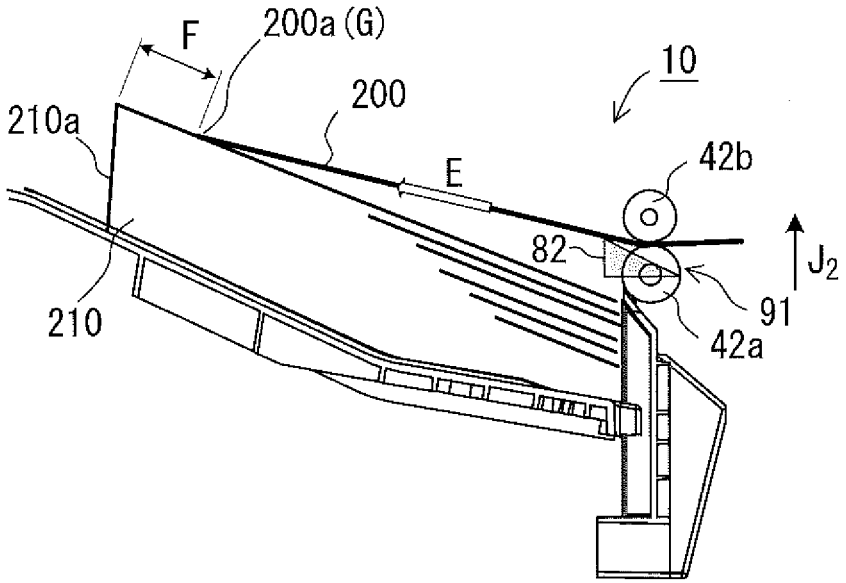
FIG. 9B is a diagram illustrating an example of discharge angle adjustment that is performed by the paper discharge wing.

FIGS. 9A and 9B are diagrams illustrating examples of discharge angle adjustment that is performed by paper discharge wings. FIG. 9A illustrates a state in which the stacked amount is small, and the FIG. 9B illustrates a state in which the stacked amount is large. The paper discharge wings 82 are provided at the right and left of the discharge port, and are configured to guide the right and left sides of the paper sheet 200 to be discharged from the discharge roller pairs 42.

A position adjustment unit 91 is provided to adjust the vertical position of the paper discharge wing 82. The vertical position of the paper discharge wing 82 is adjusted via control that is performed by the CPU 20 according to the paper sheet stacked amount and the kind of paper sheet. When the stacked amount becomes large, the paper discharge wing 82 is lifted ($J_2$ direction), and the discharge direction E is directed upward. The discharge direction E of the paper sheet 200 is changed upward, and the contact length F is kept constant regardless of the stacked amount. The same applies to the change in the kind of paper sheet.

Figure 10A:
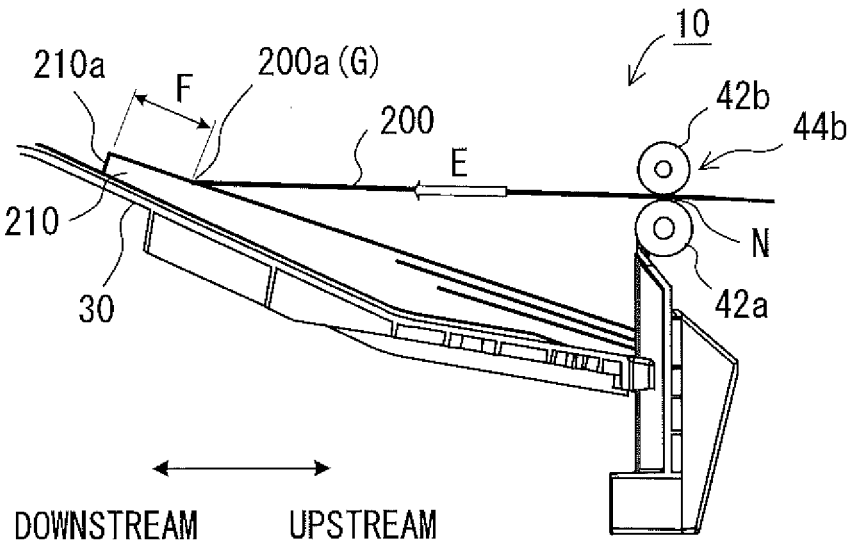
FIG. 10A is a diagram illustrating an example of discharge angle adjustment that is performed by a driven roller.
Figure 10B:
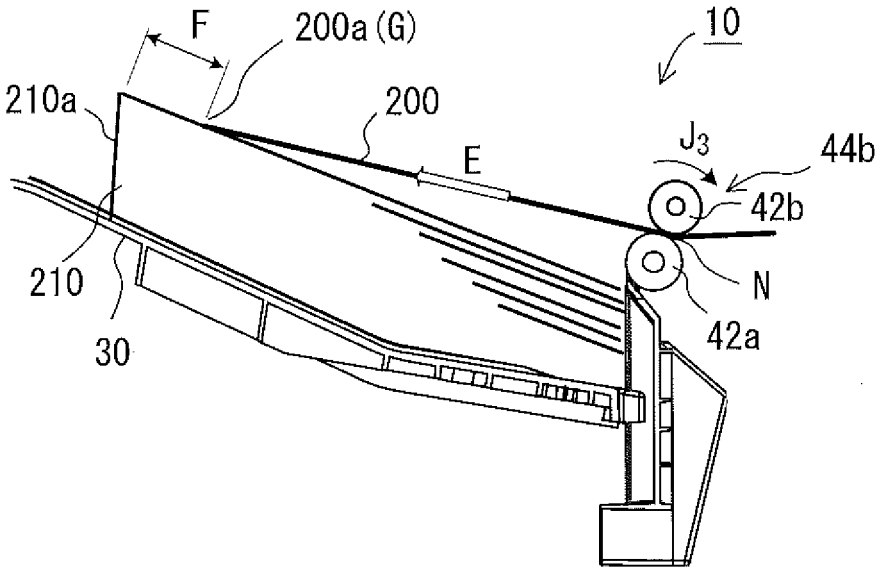
FIG. 10B is a diagram illustrating an example of discharge angle adjustment that is performed by the driven roller.
Figure 11A:
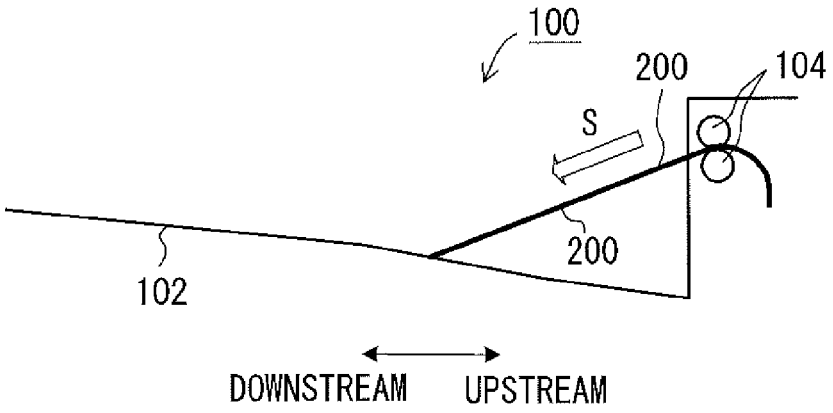
FIG. 11A is a diagram illustrating as a conventional example a paper discharge device that brings the front end of a discharged paper sheet into contact with stacked paper sheets, in a state in which there are no stacked paper sheets.
Figure 11B:
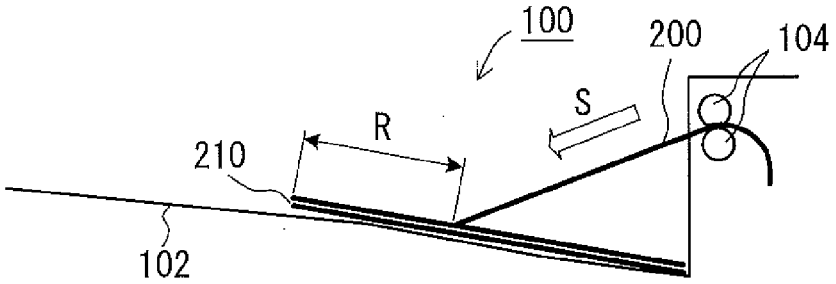
FIG. 11B is a diagram illustrating as a conventional example the paper discharge device that brings the front end of a discharged paper sheet into contact with stacked paper sheets, in a state in which there are a few stacked paper sheets.
Figure 11C:
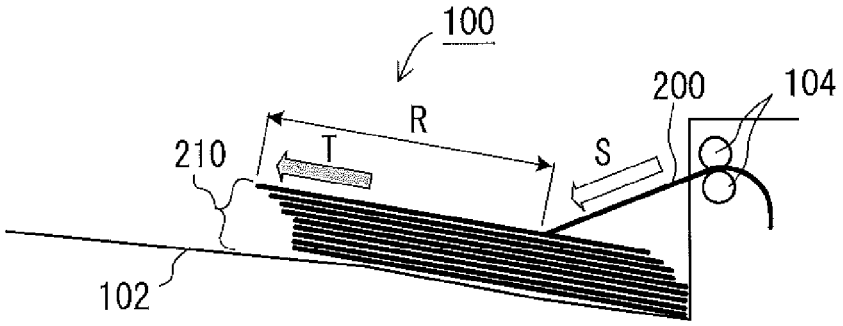
FIG. 11C is a diagram illustrating as a conventional example the paper discharge device that brings the front end of a discharge paper sheet into contact with stacked paper sheets, in a state in which there are many stacked paper sheets.
Figure 12A:
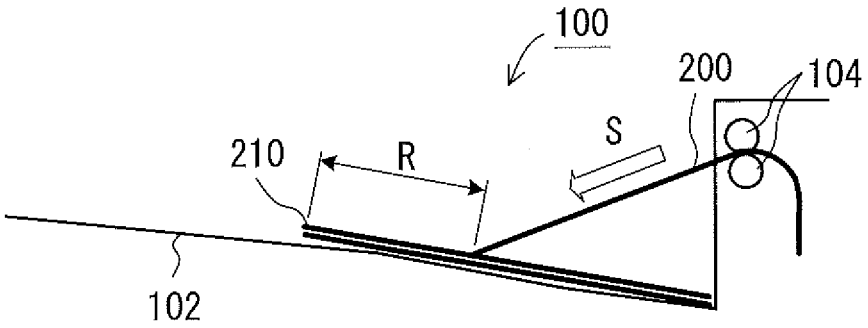
FIG. 12A is a diagram illustrating a conventional example of FIGS. 11A, 11B, and 11C, and illustrating how alignment of discharged paper sheets deteriorates when the paper sheet size is large, in a case in which the paper sheet 200 is A4 size.
Figure 12B:
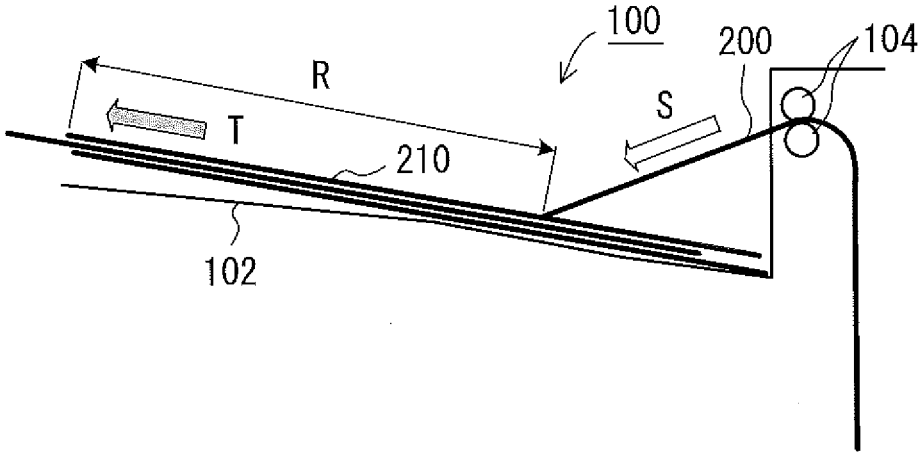
FIG. 12B is a diagram illustrating a conventional example of FIGS. 11A, 11B, and 11C, and illustrating how alignment of discharged paper sheets deteriorates when the paper sheet size is large, in a case in which the paper sheet 200 is A3 size.
Figure 13A:
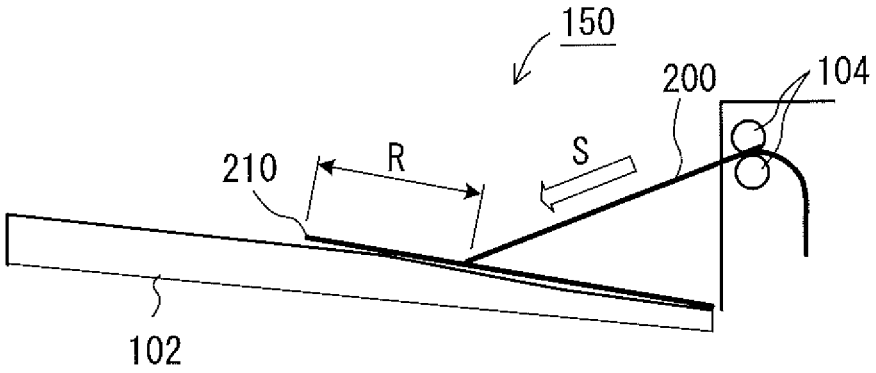
FIG. 13A is a diagram illustrating as a conventional example a paper discharge device configured to lower a paper discharge tray according to the stacked amount, in a state in which there are a few stacked paper sheets.
Figure 13B:
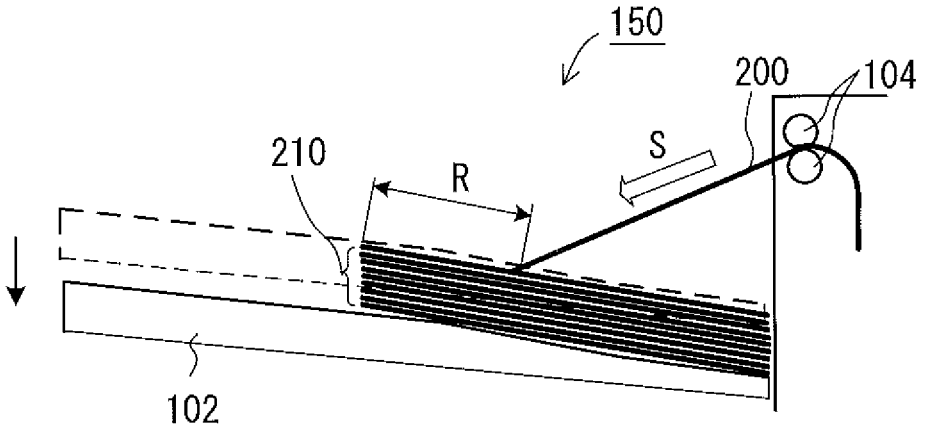
FIG. 13B is a diagram illustrating as a conventional example the paper discharge device configured to lower the paper discharge tray according to the stacked amount, in a state in which there are many stacked paper sheets.

FIGS. 10A and 10B are diagrams illustrating examples of discharge angle adjustment that is performed by the driven roller. FIG. 10A illustrates a state in which the stacked amount is small, and FIG. 10B illustrates a state in which the stacked amount is large. An angle adjustment unit 44*b* is provided to adjust the angle of the driven roller 42*b*. In the example in FIG. 1, etc., the entirety of the discharge roller pair 42 is rotated; however, in the example in FIGS. 10A and 10B, the pressing angle of the driven roller 42*b* with respect to the drive roller 42*a* is changed without changing the position of the drive roller 42*a*. That is, the nip point N is moved to an upstream side.

The angle adjustment unit 44*b* has a mechanism that is illustrated in FIGS. 6 and 7, and adjusts the pressing angle of the driven roller 42*b* instead of the entirety of the discharge roller pair 42. Corresponding to an increase in the stacked amount, the driven roller 42*b* is rotated in the $J_3$ direction, and the discharge direction E is directed upward. The discharge direction E of the paper sheet 200 is changed upward, and the contact length F is kept constant regardless of the stacked amount. The same applies to the kind of paper sheet.

According to the above-described embodiments, at least the following effects are obtained.

Accuracy in alignment of discharged paper sheets may be improved with a compact and simple configuration.

Print stains due to friction between paper sheets may be reduced.

Occurrence of a paper sheet jam due to friction between paper sheets may be prevented.

Note that in the above embodiments, an example in which the discharge angle is controlled by means of a software process that is executed by the CPU 20 that loads the control program has been described; however, part of or the entirety of the control unit may be configured of hardware.

In addition, the present invention is not limited to the above-described embodiments as they are, but may be embodied by deforming constituents within a scope not deviating from the gist of the invention at an execution step. In addition, various inventions can be made by appropriately combining a plurality of constituents that have been disclosed in the above embodiments. For example, all the constituents that have been disclosed in the embodiments may be appropriately combined. Further, constituents in different embodiments may be appropriately combined. It should be understood that various modifications and applications can be made without departing from the scope and the spirit of the invention.

LIST OF REFERENCE SYMBOLS

10 Paper discharge device
20 CPU
22 Memory
22*a* Table
24 Motor driver
26 Motor
28*a* Stacked amount detection sensor
28*b* Paper sheet thickness detection sensor
28*c* Paper sheet size detection sensor
30 Paper discharge tray
40 Discharge roller unit
42 Discharge roller pair
42*a* Drive roller
42*b* Driven roller
44, 44*a*, 44*b*, 91 Angle adjustment unit
46 Discharged paper conveying path
48 Conveying roller
52 Roller frame
56 Energizing spring
90 Base member
200 Paper sheet
210 Stacked paper sheet

What is claimed is:

1. A paper discharge device including discharge rollers that discharge a conveyed paper sheet, and a paper discharge tray on which discharged paper sheets are stacked, the paper discharge device comprising:

a control unit that controls a discharge angle of a paper sheet according to at least a stacked amount of paper sheets that are stacked on the paper discharge tray to progressively change the discharge angle as the stacked amount of paper sheets increases so that a position at which a front end of the paper sheet to be discharged begins to come into contact with the stacked paper sheets that are stacked on the paper discharge tray is maintained within a specified range from a front end of the stacked paper sheets while the paper sheet is discharged by the discharge rollers, the specified range being less than a length of the paper sheet in a discharging direction.

2. A paper discharge device including discharge rollers that discharge a conveyed paper sheet, and a paper discharge tray on which discharged paper sheets are stacked, the paper discharge device comprising:

a control unit that controls a discharge angle of a paper sheet according to at least a stacked amount of paper sheets that are stacked on the paper discharge tray so that a position at which a front end of the paper sheet to be discharged begins to come into contact with the stacked paper sheets that are stacked on the paper discharge tray is within a specified range from a front end of the stacked paper sheets while the paper sheet is discharged by the discharge rollers, wherein the control unit further controls the discharge angle of the paper sheet according to a kind of paper sheet to be discharged.

3. The paper discharge device according to claim 2, wherein the control unit controls the discharge angle of the paper sheet so that as a thickness of the paper sheet to be discharged becomes greater, or a paper sheet length along a discharge direction becomes longer, the contact start position becomes closer to the front end of the stacked paper sheets within the specified range.

* * * * *